US007984797B1

(12) United States Patent
Bieber

(10) Patent No.: US 7,984,797 B1
(45) Date of Patent: Jul. 26, 2011

(54) SOFT SIDED LUGGAGE CASE WITH INDEPENDENT WHEEL HUB

(75) Inventor: David Bieber, East Greenwich, RI (US)

(73) Assignee: Delsey Luggage, Inc., Hanover, MD (US)

( * ) Notice: Subject to any disclaimer, the term of this patent is extended or adjusted under 35 U.S.C. 154(b) by 0 days.

(21) Appl. No.: 12/901,108

(22) Filed: Oct. 8, 2010

(51) Int. Cl.
*A45C 5/14* (2006.01)

(52) U.S. Cl. ..... 190/18 A; 190/24; 190/122; 190/127; 280/37; 280/47.26; 280/644

(58) Field of Classification Search ..... 190/16, 190/18 A, 24, 39, 40, 100, 115, 122, 124, 190/126, 127; 280/26, 37, 97, 47.1–47.41, 280/644
See application file for complete search history.

(56) References Cited

U.S. PATENT DOCUMENTS 4,383,142 A * 5/1983 Kaneko ..... 190/126
4,813,520 A 3/1989 Lin
5,031,734 A * 7/1991 King ..... 190/122
5,048,649 A * 9/1991 Carpenter et al. ..... 190/18 A
5,115,895 A * 5/1992 Myers ..... 190/18 A
5,197,579 A * 3/1993 Bieber et al. ..... 190/18 A
5,393,079 A 2/1995 Wang
5,456,342 A * 10/1995 Rekuc et al. ..... 190/18 A
5,474,162 A 12/1995 Shyr et al.
5,482,147 A 1/1996 Wang
5,499,702 A * 3/1996 Wang ..... 190/115
5,529,156 A 6/1996 Yang
5,560,459 A 10/1996 Lin
5,575,361 A 11/1996 Chou
5,588,512 A 12/1996 Lin
5,634,538 A 6/1997 Tsai
5,653,319 A 8/1997 Wang
5,685,402 A 11/1997 Lin
5,743,363 A 4/1998 Rekuc et al.
5,749,446 A 5/1998 Hsieh
5,782,325 A 7/1998 O'Shea et al.
5,794,744 A 8/1998 Lin
5,833,039 A * 11/1998 Kotkins, Jr. ..... 190/115
5,875,876 A 3/1999 Wang
5,918,710 A 7/1999 Sher
6,021,874 A 2/2000 Nykoluk
6,119,835 A 9/2000 Lin
6,131,713 A * 10/2000 Sher ..... 190/122
6,148,973 A * 11/2000 Chang ..... 190/127
6,176,357 B1 1/2001 Kuo
6,186,295 B1 2/2001 Lin et al.
6,220,412 B1 4/2001 Lin
6,253,891 B1 7/2001 Miller
6,283,261 B1 9/2001 Sher
(Continued)

*Primary Examiner* — Sue A Weaver
(74) *Attorney, Agent, or Firm* — Ober, Kaler, Grimes & Shriver; Royal W. Craig; Christopher F. Lonegro

(57) ABSTRACT

A rolling soft sided luggage case enclosing a volume and having opposing sidewalls, the sidewalls being supported by a tubular strut frame structure independent of the wheel housings mounted at the rear corners of the case. A straddle bracket affixed to a middle region of a side edge of the structural base joins the rear sidewall strut to the rigid base without engaging the wheel housing in order to facilitate ease of construction and repair of the wheel bracket. The levered portion of the base to which the wheel housing is affixed serves as a dampened swing arm on which the luggage case is sprung in order to isolate the structural frame of the case from bumps while being rolled and to and dampen shocks to the structure.

20 Claims, 5 Drawing Sheets

U.S. PATENT DOCUMENTS

| | | | | |
|---|---|---|---|---|
| 6,293,378 | B1 | 9/2001 | Lin | |
| 6,315,368 | B1 | 11/2001 | Kuo | |
| 6,354,412 | B1 | 3/2002 | Kuo | |
| 6,409,283 | B1 | 6/2002 | Hsieh | |
| 6,651,792 | B1 | 11/2003 | Kuwayama | |
| 6,758,534 | B2 | 7/2004 | Lampugnani | |
| 6,769,701 | B1 | 8/2004 | Clausen | |
| 7,066,311 | B2 | 6/2006 | O'Shea | |
| 7,207,577 | B2 * | 4/2007 | Udall et al. | 280/47.26 |
| 7,237,660 | B2 | 7/2007 | Wu | |
| 7,503,439 | B2 | 3/2009 | O'Shea et al. | |
| 7,549,652 | B2 | 6/2009 | Wu | |
| 2002/0014753 | A1 | 2/2002 | Cheng | |
| 2002/0125089 | A1 | 9/2002 | Davis et al. | |
| 2002/0125669 | A1 | 9/2002 | Chang | |
| 2002/0130005 | A1 | 9/2002 | Schwartz | |
| 2003/0019705 | A1 | 1/2003 | Lau | |
| 2003/0034215 | A1 | 2/2003 | Lin | |
| 2004/0188201 | A1 | 9/2004 | Chuo | |
| 2004/0231939 | A1 | 11/2004 | Miyoshi | |
| 2004/0231940 | A1 | 11/2004 | Nykoluk | |
| 2005/0034948 | A1 * | 2/2005 | Tiramani | 190/107 |
| 2005/0077133 | A1 | 4/2005 | Cassegrain | |
| 2005/0103590 | A1 | 5/2005 | Hu | |
| 2005/0178630 | A1 | 8/2005 | Wu | |
| 2006/0137951 | A1 | 6/2006 | Lai | |
| 2007/0215427 | A1 * | 9/2007 | Rekuc et al. | 190/127 |
| 2008/0245633 | A1 | 10/2008 | Chun | |
| 2009/0101460 | A1 | 4/2009 | Justham et al. | |
| 2009/0242344 | A1 | 10/2009 | Selvi | |

* cited by examiner

SOFT SIDED LUGGAGE CASE WITH INDEPENDENT WHEEL HUB

BACKGROUND OF THE INVENTION

1. Field of the Invention

The present invention relates generally to soft sided luggage cases. More specifically, the present invention is directed to a soft sided luggage case with internal frame independent of wheel hub.

2. Description of the Background

Travelers generally desire a luggage case that is sufficiently sturdy and rugged to securely protect their items, even against the most aggressive of baggage handlers. However, increased protection typically comes at the expense of added weight at a time when most airlines have implemented checked luggage policies that impose surcharges if the weight of a piece of baggage exceeds a certain maximum, for example, 50 lbs. per bag. Moreover, travelers prefer lighter luggage for the obvious reason that it is simply more difficult to transport heavier luggage. Consequently, travelers are concerned about the weight of their empty luggage case such that soft sided luggage cases, being relatively lighter than their rigid counterparts, have become increasingly popular. Wheeled or "rolling" luggage cases have also become particularly popular because they enable travelers to roll their luggage through, for example, an airport terminal rather than carry the full weight of the bag and its contents. However, the wheels and hubs of a soft-sided rolling bag in addition to the internal support frame make up the bulk of the weight of any soft-sided rolling luggage case. The competing interests of light weight construction and robust, strong protection with easy mobility continue to present challenges to luggage designers.

Prior art internal supporting frames for soft-sided luggage cases commonly comprise a series of lightweight rods joined at the corners of the case by corner brackets. The fabric skin of the case may be stretched over the frame and affixed to the corner brackets to provide a measure of structural rigidity to the frame in addition to protection of its contents during travel. For wheeled luggage, the wheels and hubs are typically incorporated into lower corner brackets of the case to permit it to be tipped and rolled along by a traveler as opposed to carried. Luggage cases according to this design are described in U.S. Pat. No. 6,283,261; U.S. Pat. No. 5,685,402; U.S. Pat. No. 6,148,973 and U.S. patent application Ser. No. 12/244,237

Despite all efforts to develop robust, strong soft sided rolling bag designs, bag failures during travel do occur. Commonly, overloaded bags that are tossed, dropped, stacked or wheeled over rough surfaces will sustain damage to the lower corner brackets/wheel mounts, wheels and/or frames. Repair of such damage often requires replacement of the lower corner bracket/wheel mount. However, because the bracket is integrated with the rigid frame and tensioned fabric skin, disassembly for repair is difficult and time consuming, as is reassembly and, in particular, re-tensioning of the fabric skin in cases where the skin is a structural element. Consequently, damaged luggage is often simply discarded and replaced with entirely new bags, even where the damage is repairable under a manufacturer's warranty.

It would be desirable to be able to be able to remove and replace the wheel mounting point/bearing without a need to disassemble the structural frame of the case.

It would further be desirable to provide an independently sprung wheel mount and structural frame that are both robust and lightweight and which take up as little volume as possible from the space within the luggage case so as to decrease the incidence of damage to a case and permit the traveler to utilize a maximum amount of space for their items.

SUMMARY OF THE INVENTION

The present invention provides a rolling soft sided luggage case enclosing a volume and having opposing sidewalls, the sidewalls being supported by a tubular strut frame structure independent of the wheel housings mounted at the rear corners of the case. A straddle bracket affixed to a middle region of a side edge of the structural base joins the rear sidewall strut to the rigid base without engaging the wheel housing in order to facilitate ease of construction and repair of the wheel bracket. The levered portion of the base to which the wheel housing is affixed serves as a dampened swing arm on which the luggage case is sprung in order to isolate the structural frame of the case from bumps while being rolled and to and dampen shocks to the structure.

DESCRIPTION OF THE DRAWINGS

The objects, features, and advantages of the present invention will become apparent from the following detailed description of the preferred embodiments and certain modifications thereof when taken together with the accompanying drawings in which like numbers represent like items throughout and in which.

DETAILED DESCRIPTION OF THE PREFERRED EMBODIMENT

Figure 1:
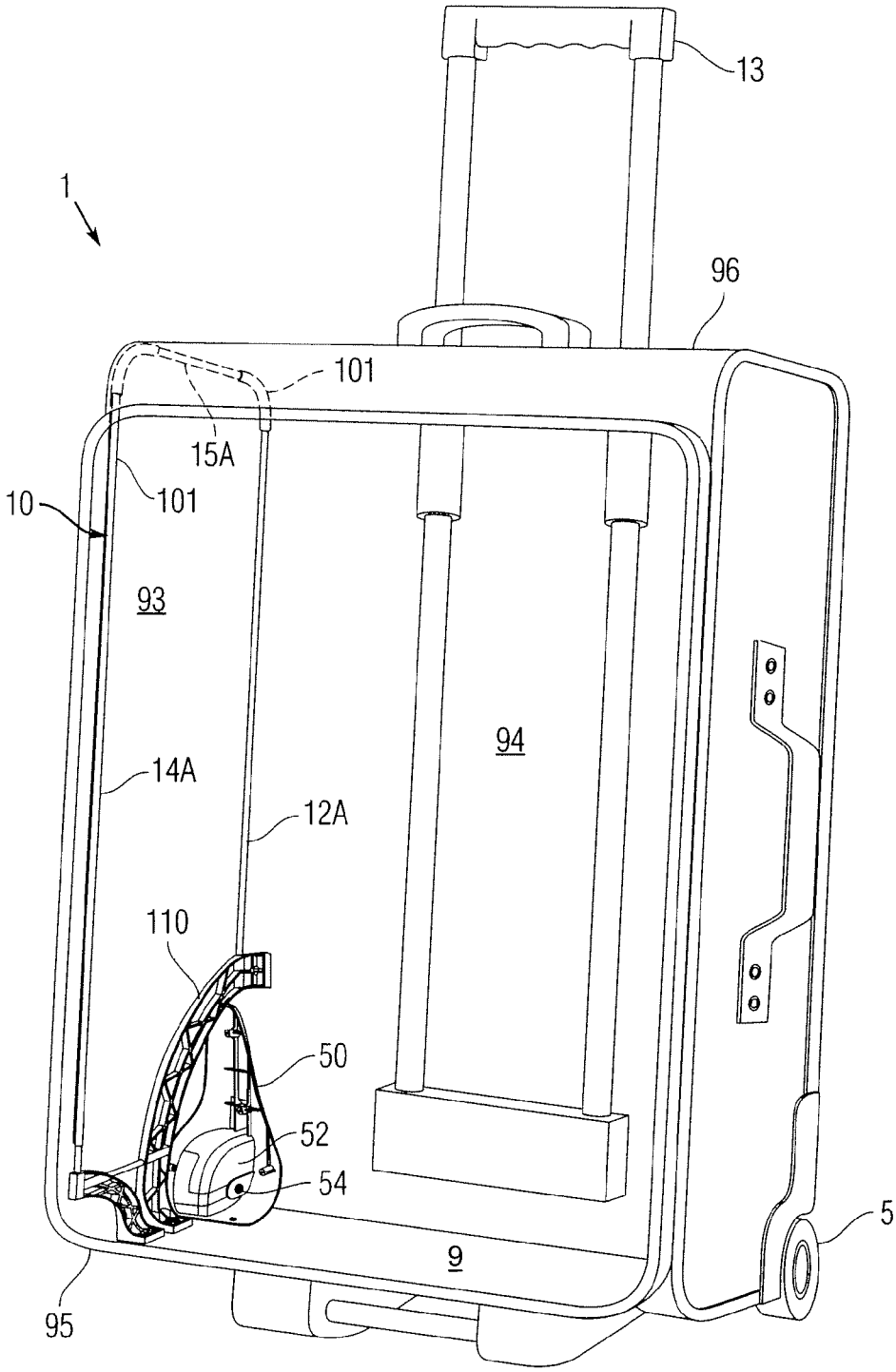
FIG. 1 is a perspective view of a luggage case according to the present invention.

For the purposes of promoting an understanding of the principles of the invention, reference will now be made to the exemplary embodiment illustrated in the drawings and described below. The embodiment disclosed is not intended to be exhaustive or limit the invention to the precise form disclosed in the following detailed description. Rather, the embodiment is chosen and described so that others skilled in the art may utilize its teachings. It will be understood that no limitation of the scope of the invention is thereby intended. The invention includes any alterations and modifications in the illustrated device, the methods of operation, and further applications of the principles of the invention which would normally occur to one skilled in the art to which the invention relates.

The disclosure is a soft-sided rolling luggage case having an internal structural frame that is independent of the wheel hubs/mount. This configuration facilitates repair by replacement of the wheel mount without the need to disassemble the structural frame and permits independent articulation of the wheel mount by flexure of the base in response to rolling obstacles. The structural elements of the case and rolling assembly are lightweight and takes up a minimum of space within the luggage case. FIG. 1 shows a front perspective view of a luggage case 1 in accordance with an aspect of the present invention. The luggage case 1 may be of any known foini and is generally comprised of opposing side walls 93, a rear wall 94, a base wall 95, a top wall 96, and a front wall which is omitted in the depicted view for clarity with regard to the internal support structure. The walls 93-96 of the case 1 define an enclosed main luggage compartment 97 inside the luggage case 1. The case is provided with a handle 13 extendable from the top wall 96 and a pair of wheels 5 (only one of which is visible in FIG. 1) at the rear corners of the base wall 95 to permit the case to be tipped back and rolled.

The walls 93-96 of the luggage case 1 are constructed of any of a variety of known woven or non-woven fabric panels and are supported by a lightweight internal support frame 10 extending upward from the base wall 95 at each of the side walls 93. The front wall is similarly constructed from a lightweight fabric and may be supported by a conventional frame or left unsupported. The front wall is preferably joined with a side wall 93 by means of a fabric hinge (not shown) and secured in place at the remainder its periphery by a zipper substantially encircling the front wall. Operation of the zipper permits access to the luggage compartment 97 of the case and items stored therein by rotation of the front wall about the hinge, as is known in the art.

The lightweight support frame 10 includes a generally planar and rigid to semi rigid base panel 9 atop the base wall 95. Alternately, the base panel 9 may be integrally formed as part of base wall 95. The base panel 9 is preferably formed of an elastic, resilient, semi-rigid lightweight polymer such as ABS, polyester, nylon or polypropylene although those skilled in the art will recognize other suitable polymers and other materials such as aluminum or carbon fiber may be used in both unreinforced and fiber reinforced forms. It should further be observed that the profile and/or cross section of the base 9 may be articulated to produce the desired flexural profile and may be further slotted, generally from the rear edge, or otherwise cut away for the same purpose, as described below.

Elongate struts 12*a*, 14*a*, on the left side and 12*b*, 14*b* on the right side (obscured) extend upward from the base panel 9 and are rigidly connected at top wall 96 by arcuate corner connectors 101 and, optionally, elongate struts 15*a*, 15*b* (obscured) so as to tension and provide support for the fabric of the side walls 93. Elongate struts 12*a*, 14*a*, 12*b*, 14*b* may also engage the periphery of side panels 93 by insertion through a fabric sleeve 98 formed at one or both edges of the panels 93. Corner connectors 101 are preferably arcuate in form, tubular and with a slot at each end for receiving the ends of the struts 12*a*, 14*a*, 15*a* on the left side and 12*b*, 14*b*, 15*b* on the right side. The arcuate shape of the corner connectors 101 provides the case 1 with a rounded side profile and enables the front and back struts on each side (e.g. 14*a* and 12*a* on the left) to be non-parallel in order to give the case a tapered depth in profile. It should be noted that the front and back struts on each side need not form a tapered profile and may be parallel.

The struts 12*a*, 13*a*, 14*a*, 15*a* on the left side and 12*b*, 13*b*, 14*b*, 15*b* (right side—obscured) are preferably round tubular but may be any form with sufficient rigidity and stiffness such as square tubular or other extrusion such as flat linear and round or rectangular solid strips. The struts may have a cross section (diameter) and wall thickness sufficient to meet the weight requirements of the luggage case in which they are utilized and are preferably between 3 and 9 millimeters in diameter. The struts may further be of constant diameter or may be tapered as desired to reduce weight and/or material use. The struts 12*a*, 13*a*, 14*a*, 15*a* on the left side and 12*b*, 13*b*, 14*b*, 15*b* may be constructed from fiberglass reinforced polymer (FRP) but may be comprised of any appropriate, lightweight material such as carbon fiber, ABS, polyester, polypropylene, aluminum or any combination thereof. The fittings (e.g. corner connectors 101, straddle brackets, and straddle arms as described below) and base 9 may be molded from polypropylene, but may alternately or additionally be comprised of acrylonitrile butadiene styrene (ABS), polycarbonate, nylon, glass filled polymer and/or metal or any combination thereof, with or without fiber reinforcement.

Figure 2:
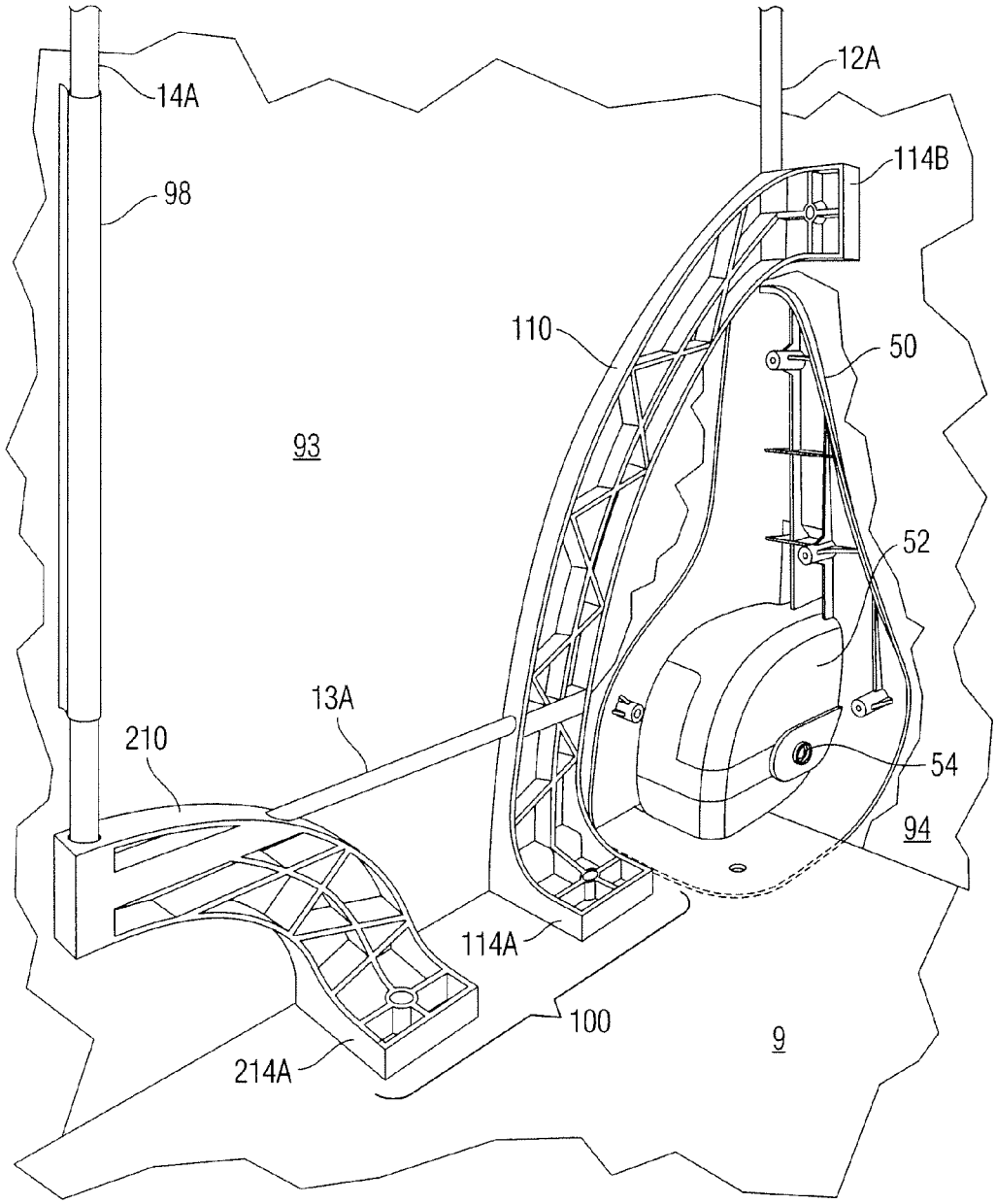
FIG. 2 is a detail perspective view of the straddle bracket of the present invention as incorporated into the luggage case if FIG. 1.
Figure 5:
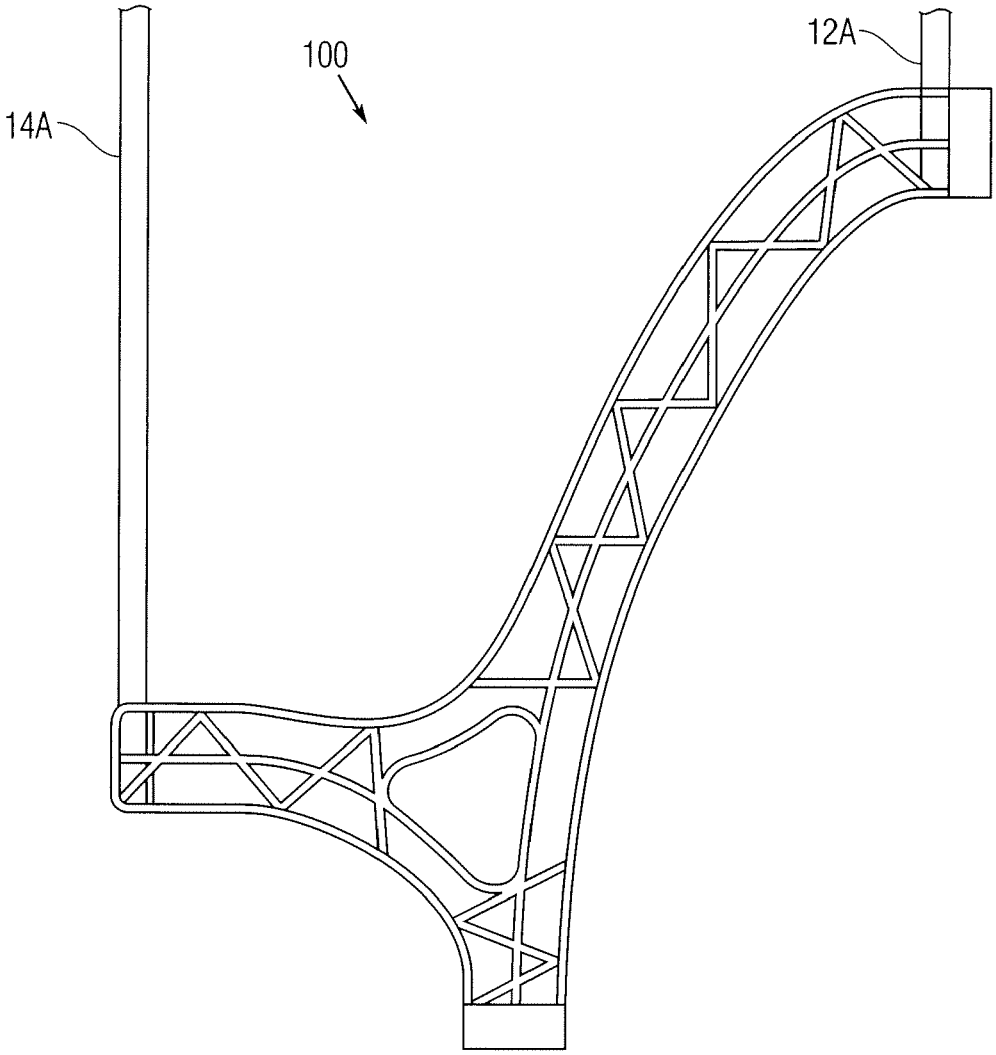
FIG. 5 is an elevation view of an alternate embodiment of the straddle bracket of the present invention.

With reference to FIG. 2, the elongate struts 14*a*, 14*b* and 12*a*, 12*b* extending downward from fittings 101 at the front and rear edges of the side walls 93, respectively, do not extend all the way to the base panel 9 or base wall 95 but instead connect to straddle brackets 100 engaged to the base panel 9 at or near its side edge. In a preferred embodiment the straddle brackets engage the base panel 9 in a central region with respect to the depth of base panel 9. The straddle brackets 100 are made up of front and rear straddle arms 210, 110, respectively, which are themselves joined by an elongate strut 13*a*. The front and rear straddle arms 210, 110 extend upward and out from the central region of the base to the front wall and rear wall 94 to isolate the lower corners of the compartment 97 from the structural frame 10. In the depicted and preferred embodiment the straddle arms 210, 110 are arcuate members to maximize the space available at the corners of the base panel 9 for locating wheel housings 50 as described below. The straddle arms 210, 110 form a single rigid body by connection with the base 9 and elongate strut 13*a* or 13*b*. In alternate embodiments the straddle arms 210, 110 may be linear members (i.e. not curved), may be integrated into a straddle bracket of single unit construction (as seen in FIG. 5) and/or may eliminate the elongate member 13A. In certain other embodiments the front straddle arm 210 may be omitted entirely in favor of a simple bracket to receive the end of the strut 14*a*, 14*b*.

Figures 3A, 3B, 3C, 3D:
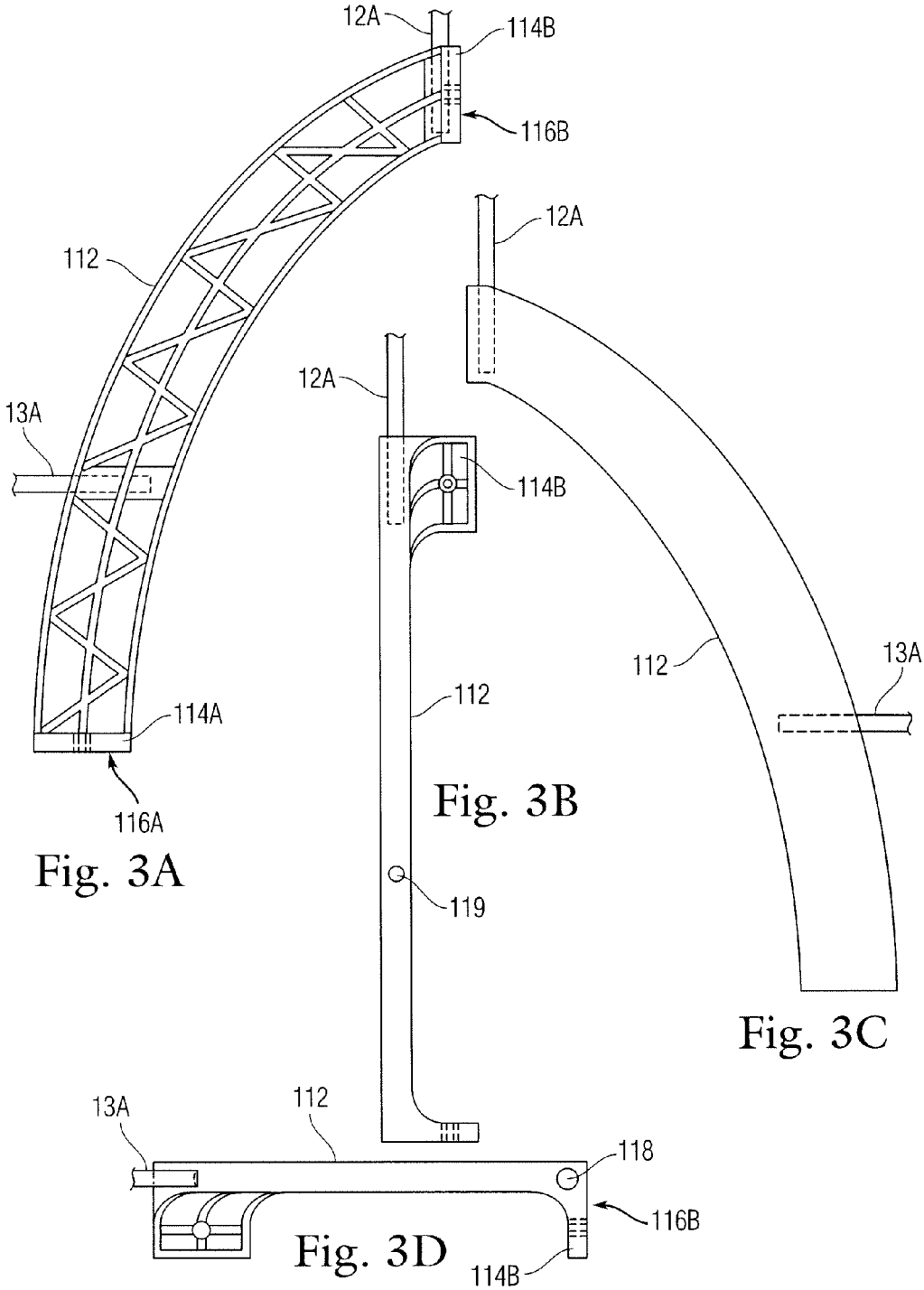
FIGS. 3*a* through 3*d* are elevation and top views of the rear straddle arm of the present invention.
Figures 4A, 4B, 4C:
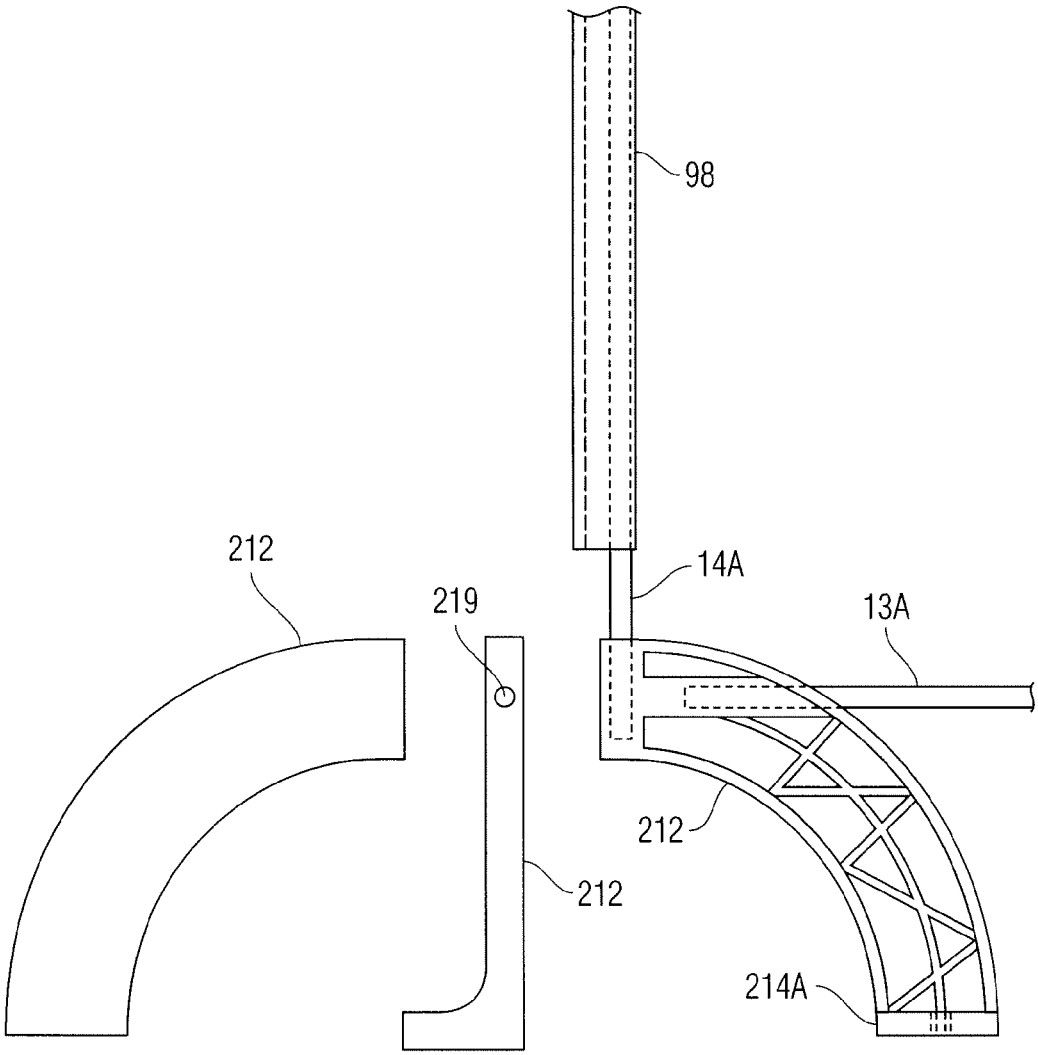
FIGS. 4*a* through 4*d* are elevation and top views of the front straddle arm of the present invention.
Figure 4D:
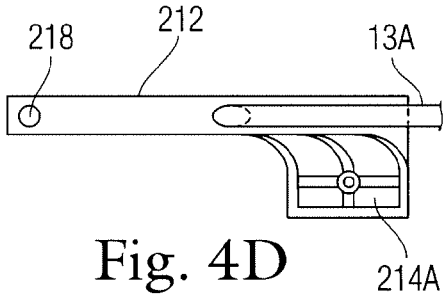

With additional reference to FIGS. 3 and 4, the lower ends of the elongate struts 12*a*, 12*b* at the rear edges of the sidewalls are received in a straddle arm 110. The straddle arm 110 is preferably a support member having an arcuate body portion 112 and having at its lower end a proximal mounting flange 114*a* and at its upper end a distal mounting flange 114*b*. The arcuate body portion 112 is preferably a flat, linear form and is further constructed of a series of engineered web and flange elements so as to be light yet rigid. The mounting flanges 114*a* and 114*b* are orthogonal to the plane of the body portion 112 so as to present outer flange edges 116*a* and 116*b* parallel to the plane of the base panel 9 and rear wall 94, respectively. Where the luggage base and back wall are at an angle of 90°, as is common, outer flange edges 116*a* and 116*b* would like wise form a 90° angle to one another. One skilled in the art will recognize the need to match the included angle $\alpha$ as dictated by the overall luggage case shape and geometry.

A mechanical fastener secures the proximal flange 114*a* to the base panel 9 and distal flange 114*b* to the fabric of the rear wall 94. The fabric of the side wall 93 may be likewise fastened to the straddle bracket by mechanical fasteners (not visible) or other appropriate means. A slot 118 is provided in the upper surface of flange 114*b* to receive the lower ends of the elongate struts 12*a*, 12*b*. The curvature of the straddle arm 110 is such that the elongate struts 12*a*, 12*b* are intercepted above the wheel housing 50 which is independently mounted to the base 9 as further described below. A second slot 119 is provided in the forward surface of body portion 112 in which to receive an end of the lower transverse struts 13*a*, 13*b*. Another end of the lower transverse strut 13*a*, 13*b* is engaged to a cooperatively aligned slot 219 in a forward straddle arm 210. While the straddle arms 110 define approximately 90° angles between the rods 12*a*, 12*b* and 13*a*, 13*b*, it will be evident to those skilled in the art that the angle defined may be any appropriate angle.

The lower ends of the elongate struts 14*a*, 14*b* at the front edges of the sidewalls 93 are similarly received in the forward straddle arm 210. The forward straddle arm 210 is preferably a support member having an arcuate body portion 212 and having at its lower, proximal end a mounting flange 214 for engagement with the base panel 9. The arcuate body portion 212 is, as above, preferably a flat, linear form and is further constructed of a series of engineered web and flange elements so as to be light yet rigid. The mounting flange 214 is orthogonal to the plane of the body portion 212 for engagement to the base panel 9 at an angle cooperative to the geometry of the straddle arm 110. A mechanical fastener secures the flanges 214 to the base panel 9. A slot 218 is provided in the upper surface of the body portion 212 to receive the lower ends of the elongate struts 14*a*, 14*b*. It should be observed that in an alternate embodiment the forward saddle arm 210 may be omitted and the elongate struts 14*a*, 14*b* received directly in the base panel 9 for example in a slot formed therein or by a simple bracket. In such an embodiment it is generally necessary to enlarge or reinforce at least the forward portion of the base panel 9.

With renewed reference to FIG. 2, the wheels 5 are rotatably fixed in a wheel housing 50 at each of the rear corners of the base panel 9. The wheel housing 50 is placed as close to the corners as possible and preferably at the corners in order to give the case 1 the widest possible wheelbase and thus the greatest overall rolling stability. The wheel housing 50 comprising a wheel well 52 and hub 54 and is attached on the outer surface of the case 1 by mechanical fasteners through the base wall 95 and into the base panel 9. The wheel housing 50 may be further attached to the flexible fabric of the side wall 93 and rear wall 94 by mechanical fasteners. With the wheels 5 so mounted the rear portion of the plate 9 is free to flex and thereby act as a moment arm on which the wheels are free to move independently of the structural frame 10 as the bag is rolled during use. In this manner, the severity of bumps to the case is mitigated and shocks are partially or totally absorbed without being passed to the structural frame 10.

The material properties and thickness of the base panel 9 may be selected to provide the desired amount of flexure in the base and thereby achieve the desired level of frame isolation and shock absorption. Additionally, the position within the middle portion of the base at which the straddle brackets 100 engage the base panel 9 can be adjusted thereby altering the length of the moment arm and thus its shock absorption and mitigation characteristics. The more forward the straddle bracket mounting point, the longer the moment arm formed by the rear portion of the base and thus the greater its shock absorbing and dampening effect. Consequently, the middle portion, while preferably approximately the middle third of the depth of the base panel 9, is defined for purposes of this application as that portion of the base panel 9 forward of the wheel housing 50 mounted at the rear edge of the base panel 9, extending to and including the forward edge of the base panel 9.

Further, being totally independent of the structural frame 10 and straddle bracket 100, the wheels 5 and wheel housing 50 can be easily repaired or replaced without the need to disassemble the structural frame or remove the fabric skin. Further, the resulting structural frame is both robust and lightweight and takes up as little volume as possible from the space within the luggage case so as to permit the traveler to utilize a maximum amount of space for their items. The base 9 also provides a point of attachment for other common elements of luggage cases such as a trolley handle 13 which is typically attached by a mounting plate to the luggage base and extends upward to extendably exit the top of the luggage to facilitate tipping and rolling the case on its wheels. Such a configuration is in keeping with the present invention although securing the vertical members of the trolley handle 13 to the base panel 9 fixes the middle of the back edge of the panel 9 to the frame 10 and reduces the movement of the base panel 9 as a moment arm. In an alternate embodiment the trolley handle 13 is engaged to a transverse member in the rear wall 94 or to the rear wall 94 itself so as not to engage the base and impede the shock absorbing effect. It should be appreciated that the internal support structure, when mounted within the luggage case 1, will be covered by an inner fabric layer (not shown for clarity) so as not to expose the support structure to the main luggage compartment 97.

A preferred embodiment of a luggage case in accordance with the present invention has been described above along with certain alternate embodiments. It will be appreciated that there are other embodiments of luggage cases also in accordance with the present invention. In other embodiments of the support structure, two more inner corner bracket parts and a further rod may be provided to form an enclosed quadrilateral shaped frame extending all around the side wall of the case. It will be clear that yet further embodiments of the present invention may incorporate greater or fewer inner corner bracket parts and rods. In the above described specific embodiment the front wall of the case may be constructed from a lightweight fabric panel of material supported by a conventional wire frame, but will be appreciated that any appropriate alternative frame may be used, such as one or more extruded rods fixedly connected using molded corner brackets similar to the rods and brackets which are connected to the side walls of the case described above.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims and may be used with a variety of materials and components. This application is therefore intended to cover any variations, uses, or adaptations of the invention using its general principles. Further, this application is intended to cover such departures from the present disclosure as come within known or customary practice in the art to which this invention pertains.

I claim:

1. A structural support system for a rolling, fabric sided luggage case, said case defining an internal volume for retention of articles to be transported and having a pair of opposing side walls each having a perimeter including a front edge, a back edge, an upper edge and a lower edge; a substantially planar bottom wall joining said lower edges of said opposing side walls; and a substantially planar rear wall joining said rear edges of said opposing side walls; said structural system, comprising a planar base adjacent to said bottom wall;

at least one wheel housing secured to a rear edge of said base adjacent to each of said side walls;

a structural frame adjacent to each of said side walls; each of said structural frames comprising at least one elongate strut positioned along at least a portion of said perimeter;

a straddle bracket further comprising a straddle arm having an elongate body, a proximal mounting surface at a first end of said body, a distal mounting surface at a second end of said body, and a first slot in said second end;

wherein said proximal mounting surface is rigidly engaged to a middle portion of said base, said body is inclined upward therefrom to said distal mounting surface engaged to said rear wall at a point above said at least one wheel housing, and an end of said at least one elongate strut is engaged to said first slot;

such that said wheel housings are independent of said structural frame.

2. The structural support system for a rolling, fabric sided luggage case of claim 1;

wherein said at least one elongate strut positioned along at least a portion of said perimeter comprises at least a first elongate strut and a second elongate strut;

wherein said straddle bracket comprises a second straddle arm, said second straddle arm having an elongate body, a proximal mounting surface at a first end of said body, and a second slot in said second end; and wherein said proximal mounting surface of said second straddle arm is rigidly engaged to a middle portion of said base, said body is inclined upward therefrom to said second end adjacent to said front edge of said side wall, and an end of said second elongate strut is engaged to said second slot.

3. The structural support system for a rolling, fabric sided luggage case of claim 2 wherein said first straddle arm elongate body further comprises a third slot and said second straddle arm elongate body further comprises a fourth slot; and wherein said straddle bracket further comprises a third elongate strut engaged at a first end in said third slot and engaged at a second end in said fourth slot.

4. The structural support system for a rolling, fabric sided luggage case of claim 2 wherein said at least one elongate strut positioned along at least a portion of said perimeter further comprises a third elongate strut engaged at one end to said first elongate strut and another end to said second elongate strut.

5. The structural support system for a rolling, fabric sided luggage case of claim 2 wherein said first straddle arm elongate body and said second straddle arm elongate body are each arcuate members.

6. The structural support system for a rolling, fabric sided luggage case of claim 1 wherein said distal mounting flange surface includes a secured to said rear wall by mechanical fasteners selected from the group consisting of a screw and a rivet.

7. The structural support system for a fabric sided luggage case of claim 1 wherein said at least one elongate strut is of a cross section shape selected from the group consisting of round tubular, rectangular tubular, round solid, rectangular solid and flat solid.

8. The structural support system for a fabric sided luggage case of claim 1 wherein said planar base is semi-rigid.

9. The structural support system for a fabric sided luggage case of claim 1 wherein said planar base is constructed of a semi-rigid polymer.

10. The structural support system for a fabric sided luggage case of claim 9 wherein said semi-rigid polymer is chosen from the group consisting of ABS, polyester, nylon and polypropylene.

11. The structural support system for a fabric sided luggage case of claim 9 wherein said semi-rigid polymer is fiber reinforced.

12. A structural support system for a rolling, fabric sided luggage case, said case defining an internal volume for retention of articles to be transported and having a pair of opposing side walls each having a perimeter including a front edge, a back edge, an upper edge and a lower edge; a substantially planar bottom wall joining said lower edges of said opposing side walls; and a substantially planar rear wall joining said rear edges of said opposing side walls; said structural system, comprising a planar base adjacent to said bottom wall;

a first wheel housing secured to a rear edge of said base adjacent to a first of said side walls;

a second wheel housing secured to a rear edge of said base adjacent to a second of said side walls;

a structural frame adjacent to each of said side walls; each of said structural frames comprising a first elongate strut positioned along said rear edge of said perimeter;

a second elongate strut positioned along said upper edge of said perimeter and joined to said first elongate strut;

a third elongate strut positioned along said front edge of said perimeter and joined to said second elongate strut a straddle bracket further comprising a first straddle arm comprising an elongate body;

a first proximal mounting surface at a first end of said body;

a distal mounting surface at a second end of said body;

a first slot in said second end; and a second slot in said elongate body;

wherein said proximal mounting surface of said first straddle arm is rigidly engaged to a middle portion of said base, said body is inclined upward therefrom to said distal mounting surface engaged to said rear wall at a point above said wheel housings, and an end of said first elongate strut is engaged to said first slot;

a second straddle arm comprising an elongate body;

a proximal mounting surface at a first end of said body;

a third slot in a second end of said body; and a fourth slot in said elongate body;

wherein said proximal mounting surface of said second straddle arm is rigidly engaged to a middle portion of said base, said body is inclined upward therefrom to said second end adjacent to said front edge of said side wall, and an end of said third elongate strut is engaged to said fourth slot; and a fourth elongate strut engaged at a first end in said second slot and engaged at a second end in said fourth slot;

such that said wheel housings are independent of said structural frame.

13. The structural support system for a rolling, fabric sided luggage case of claim 12 wherein said first straddle arm elongate body and said second straddle arm elongate body are each arcuate members.

14. The structural support system for a rolling, fabric sided luggage case of claim 12 wherein said distal mounting flange surface includes a secured to said rear wall by mechanical fasteners selected from the group consisting of a screw and a rivet.

15. The structural support system for a fabric sided luggage case of claim 12 wherein said elongate struts are of a cross section shape selected from the group consisting of round tubular, rectangular tubular, round solid, rectangular solid and flat solid.

16. The structural support system for a fabric sided luggage case of claim 12 wherein said planar base is semi-rigid.

17. The structural support system for a fabric sided luggage case of claim 16 wherein said planar base is constructed of a semi-rigid polymer.

18. The structural support system for a fabric sided luggage case of claim 17 wherein said semi-rigid polymer is chosen from the group consisting of ABS, polyester and polypropylene.

19. The structural support system for a fabric sided luggage case of claim 17 wherein said semi-rigid polymer is fiber reinforced.

20. A fabric sided luggage case defining an internal volume, comprising a pair of substantially rectilinear opposing side walls each having a perimeter including a front edge, a back edge, an upper edge and a lower edge, a planar bottom wall joining said lower edges of said opposing side walls, a planar rear wall joining said rear edges of said opposing side walls a planar base adjacent to said bottom wall;

a first wheel housing secured to a rear edge of said base adjacent to a first of said side walls;

a second wheel housing secured to a rear edge of said base adjacent to a second of said side walls;

a structural frame adjacent to each of said side walls; each of said structural frames comprising a first elongate strut positioned along said rear edge of said perimeter;

a second elongate strut positioned along said upper edge of said perimeter and joined to said first elongate strut;

a third elongate strut positioned along said front edge of said perimeter and joined to said second elongate strut a straddle bracket further comprising a first straddle arm, comprising an elongate body;

a first proximal mounting surface at a first end of said body;

a distal mounting surface at a second end of said body;

a first slot in said second end; and a second slot in said elongate body;

wherein said proximal mounting surface of said first straddle arm is rigidly engaged to a middle portion of said base, said body is inclined upward therefrom to said distal mounting surface engaged to said rear wall at a point above said wheel housings, and an end of said first elongate strut is engaged to said first slot;

a second straddle arm, comprising an elongate body;

a proximal mounting surface at a first end of said body;

a third slot in a second end of said body; and a fourth slot in said elongate body;

wherein said proximal mounting surface of said second straddle arm is rigidly engaged to a middle portion of said base, said body is inclined upward therefrom to said second end adjacent to said front edge of said side wall, and an end of said third elongate strut is engaged to said fourth slot; and a fourth elongate strut engaged at a first end in said second slot and engaged at a second end in said fourth slot;

such that said wheel housings are independent of said structural frame.

* * * * *